US010269216B1

(12) United States Patent
Lafroscia et al.

(10) Patent No.: US 10,269,216 B1
(45) Date of Patent: Apr. 23, 2019

(54) CASINO CARD-BASED GAME AND METHOD OF PLAY

(71) Applicants: Michael A. Lafroscia, Boynton Beach, FL (US); William J. Smith, Boca Raton, FL (US)

(72) Inventors: Michael A. Lafroscia, Boynton Beach, FL (US); William J. Smith, Boca Raton, FL (US)

( * ) Notice: Subject to any disclaimer, the term of this patent is extended or adjusted under 35 U.S.C. 154(b) by 417 days.

(21) Appl. No.: 14/089,400

(22) Filed: Nov. 25, 2013

(51) Int. Cl.
*G07F 17/32* (2006.01)
*A63F 1/00* (2006.01)

(52) U.S. Cl.
CPC ..... *G07F 17/3258* (2013.01); *A63F 1/00* (2013.01); *G07F 17/3293* (2013.01)

(58) Field of Classification Search
CPC ..... G07F 17/3258
See application file for complete search history.

(56) References Cited

U.S. PATENT DOCUMENTS 5,382,025 A 1/1995 Sklansky et al.
5,531,448 A * 7/1996 Moody ..... 273/292
5,657,993 A 8/1997 Merlino et al.
5,722,661 A 3/1998 Skratulia et al.
6,332,614 B1 12/2001 Hesse
6,793,220 B1 * 9/2004 Feola ..... 273/292
7,690,655 B2 4/2010 Moody
7,722,048 B2 5/2010 Smith et al.
8,333,646 B2 12/2012 Feola
2006/0119044 A1 * 6/2006 Kekempanos ..... A63F 3/00157 273/292
2007/0045958 A1 * 3/2007 Rader ..... G07F 17/32 273/274
2010/0259003 A1 * 10/2010 Haag ..... A63F 1/00 273/292
2011/0034240 A1 * 2/2011 Naicker ..... G07F 17/32 463/27
2012/0244924 A1 * 9/2012 Willis ..... 463/12
2014/0141854 A1 * 5/2014 Sholes ..... G07F 17/326 463/13

OTHER PUBLICATIONS www_poker_com-game-community-poker-games-rockleigh_htm.
www_poker_com-game-community-poker-games-twin-beds_htm.

* cited by examiner

*Primary Examiner* — Tramar Y Harper
*Assistant Examiner* — Jeffrey K Wong
(74) *Attorney, Agent, or Firm* — Glenn E. Gold, P.A.; Glenn E. Gold

(57) ABSTRACT

A method of playing a casino card game includes providing an automatic shuffling machine and a gaming table having a plurality of playing stations and a community card area. Each player antes. A hand of five cards is dealt to each player, and a plurality of community card pairs are distributed to the community area. Each player reviews the dealt hand to determine whether to fold or play, and all remaining players are required to wager a fixed amount. A community card pair is turned face up, and each player then determines whether to fold or play. Each player wagers based on the combination of the player's five-card hand and the turned community pair. The wagers are collected, and the steps of turning and wagering are repeated until all community card pairs are turned face up. The combined wagers are awarded to the player having the highest ranking hand.

7 Claims, 3 Drawing Sheets

CASINO CARD-BASED GAME AND METHOD OF PLAY

FIELD OF THE INVENTION

The present disclosure generally relates to casino card games. More particularly, the present disclosure relates to a Poker-based casino card game and style of betting on the outcome of the card game.

BACKGROUND OF THE INVENTION

Card games have enjoyed varying degrees of popularity throughout the years. A card game is any game using playing cards as the primary device with which the game is played. A traditional deck of cards is typically comprised of four suits (Hearts, Diamonds, Clubs, and Spades) of thirteen cards in each suit. The thirteen (13) cards range from two (2) through ten (10) showing a corresponding number of suit icons on the face of each card, and four face cards (Jack, Queen, King and Ace). During play in a typical game the cards are increasingly valued from the two (lowest value) to the ace (highest value). Oftentimes an ace can be valued either high (above the king) or low (below the two). The suits can also be ranked in power such that each card in the deck has a unique valuation for the purpose of determining which individual card in a determinative subset of cards is the highest ranking or most powerful card.

While many card games have become popular parlor games played in social groups for entertainment and social value, a number of games and variants thereof have also been adapted as casino games during which the players bet money and the casino derives an element of income therefrom either by collecting a rake or by having a so-called House hand included in the play. The most popular games played in casinos are Poker, Blackjack, Baccarat and variants of these games. In a typical game, a plurality of cards are dealt to the players who then, in turn, bet on the relative value of the subset of cards that they hold in their hand with respect to the unknown subset of cards the other players or the House hold(s). The games have become enormously popular live, online, via electronic casino machines and, increasingly, via mobile device applications. Poker is so popular that there are huge subsets of card players who actually make their living playing cards.

Various Indian tribes operate casinos on tribal land to provide employment and revenue for their government and their tribe members. Tribal gaming is regulated on the tribal, state and federal level. Federal regulation of Indian gaming was established under the Indian Gaming Regulatory Act of 1988. Under the provisions of that law, games are divided into three distinct categories: Class I games are "traditional" games that involve little or no wagering; Class II games include certain non-banked card games, including Poker; and Class III games include all casino games (e.g., Craps, Roulette, Blackjack, Baccarat and Slot Machines), and other games where the player bets against the House.

Unfortunately, conventional Poker is one of the less profitable uses of space for a casino. In so-called Class II gaming, players are competing against each other rather than against the House. Thus, for example, before a Class II slot machine game can be played, there must be at least two players who are playing at the same time. On the other hand, in so-called Class III gaming, players are competing against the House. There are a host of limitations associated with a Class II designation.

With regard to Poker-based games, Class II casinos are very limited in the types of games that can be offered, since the games must be dictated by Player vs. Player style play. For instance, Class III casinos are able to offer "Player vs. House" style play for Poker-based table games such as, for example, PAI GOW POKER, CARIBBEAN STUD POKER and CRAZY 4 POKER. By comparison, Class II casinos are generally limited to House-dealt "Player vs. Player" style cash games and tournament play.

Typically, the casino profitability (based upon casino game floor space) of Class III type Poker games is greater than it is for Class II type Poker games. This is due to a number of factors, including, but not limited to:

(1) Speed of play—Class II Poker games are typically more slowly paced than Class III Poker table games. Class II Poker games tend to be relatively slow because bet selection can take a long time and the variety of decisions that make the game so strategically stimulating also stifle play.

(2) House rake limits—This aforementioned relatively slow rate of game play, necessarily results in a respective limit to the frequency at which House rakes occur. Furthermore, conventional Class II Poker games typically incorporate limited (relatively low percentage) House rakes vis-à-vis Class III Poker-based and other table games, which generally have a much higher vigorish (built in house percent advantage or edge).

(3) Player friendliness—Casino patrons are more apt to be intimidated by Class II Poker games than they are by Class III Poker table style games. Since conventional Poker games, such as those typically played in Class II casinos, necessarily require patrons to have a minimum skill level to have even the slightest chance of profiting against more skilled players, there is a tendency for novice players to shy away from participating. As a result, the potential patron participation pool for conventional Poker games played in Class II casinos is severely restricted compared with table-based Class III casino counterpart games.

Therefore, there has been a constant drive by operators of Class II casinos in the gaming industry to derive ways of increasing profitability of floor games vis-à-vis floor space.

Therefore, there is a long felt but unmet need in the industry for a Class II qualified Poker-style casino game that is more profitable for the casino to operate, yet provides the player with the independent betting experience similar to Poker where the betting rules are not as structured and restrained as with other table games and wherein the pace of the game is more rapid than that of conventional Player vs. Player style Poker. It would be highly desirable to provide such a game that is more inviting to less experienced Poker players by greatly reducing the required skill level (i.e., leveling the playing field), eliminates the ability for more experienced players to bluff (thereby, encouraging players to tend to play to completion of the hand), provides multiple opportunities for each player to win, taps into player curiosity (i.e., so-called rabbit hunting), eliminates the potential for player collusion, is adapted for play on a standard Blackjack or Mini-Baccarat style table, can be played with a progressive jackpot (player funded), can be House-banked or non-banked, can be played with a minimum of two players, and can be easily adapted to be implemented into a slot machine.

SUMMARY OF THE INVENTION

The present disclosure is generally directed to a method of playing a casino card game amongst a plurality of wagering players. The method includes providing an automatic shuffling machine to transform a plurality of playing cards from an initial order into a further randomized order and a gaming table having a plurality of wagering legends imprinted thereon at a plurality of playing stations and a community card area for receiving a plurality of community card pairs. Each of the plurality of players antes a predetermined amount prior to play of the game. A hand of five cards is dealt to each player in a face-down manner and a plurality of face-down community card pairs are distributed to the community area of the gaming table. Each player is allowed to review the hand of five cards to determine the player's course of action selected from the group consisting of folding and playing. All players electing to continue playing are required to wager a fixed amount. A pair of community cards are turned face up, and each player then determines the player's course of action selected from the group consisting of folding and playing. Each player wagers based on a hand derived from the combination of the player's hand of five cards and the overturned community pair. The individual wagers are collected and the turning step, action determining step, wagering step, and collecting step are repeated until all community card pairs are turned face up. A highest ranking hand is determined from the players who have not selected the action of folding, by combining the player's five-card hand with one of the turned community card pairs. The combined ante and wagers are awarded to the player determined to have the highest ranking 5-card hand.

In another aspect, the distributing step includes distributing five community card pairs to the community area of the gaming table.

In still another aspect, the wagering step includes wagering a fixed amount.

In yet another aspect, the wagering step includes wagering, raising, and calling within a range of pre-established limits.

In a still further aspect, the house retains a fixed rake from each round of wagering.

In another aspect, the individual antes are collected into a single pot and a fixed rake amount is retained therefrom by the house.

In another aspect, the highest ranking hand is determined according to standard Poker hand rankings.

In a still further aspect, after anteing, a random number generator is activated to determine the starting player for receiving the first dealt hand of five cards.

In yet another aspect, the executable instruction set includes an implementation of a progressive jackpot carried forward from sequential previous players wherein after anteing an optional jackpot wager is placed independent of the ante and regular play wagers. The jackpot is awarded to a player whose hand in combination with one of the community card pairs ranks within a defined top category of hand rankings.

In another aspect, the jackpot is awarded to a player whose hand, in combination with one of the community card pairs, results in a hand selected from the group consisting of a royal flush and a straight flush.

In still another aspect, a method of playing a casino card game includes providing a player access to a computer having a central processing unit, a memory having retained thereon an instruction set for playing the casino card game and executable by the central processing unit, a display for displaying aspects of the casino card game to the player, and a user input device. A casino card game display is shown to the player and includes a wagering pot, a community card area for displaying community cards, and at least one player station wherein the station includes a card placement legend for receiving a hand dealt the player and a wagering icon. A representation of five cards is dealt and displayed on the card placement legend for the player's hand and at least one pair of community cards is shown in the community card area. A fixed wager is placed based on the player's five-card hand. A pair of community cards is exposed face up, and the player determines a course of action of whether to fold or play. The player wagers on the combination of the player's hand and the exposed community pair. The wager is collected for placement in the wager pot. The steps of exposing, action determination, wagering, and collecting of the wager are repeated until all community card pairs are exposed. The highest ranking combination of the player's hand in combination with one of the exposed community pairs is determined, and a payoff to the player is based upon the odds of acquiring the determined highest ranking card combination.

In yet another aspect, the distributing step includes displaying five community card pairs in the community area of the display.

In another aspect, the wagering step includes wagering a fixed amount.

In still another aspect, the highest ranking combination is determined according to standard Poker hand rankings.

In yet another aspect, the display further includes a progressive jackpot legend and the executable instruction set includes an implementation of a progressive jackpot carried forward from sequential previous players and further includes after the displaying step the step of placing an optional jackpot wager independent of the ante and regular play wagers. Further, after the step of determining a highest ranking combination, including the step of awarding the jackpot to a player whose hand in combination with one of the community card pairs ranks within a defined top category of hand rankings.

In a still further aspect, the jackpot is awarded to a player whose hand in combination with one of the community card pairs is one of a group consisting of a royal flush and a straight flush.

In another aspect, the displaying step includes displaying a plurality of player stations on the display and including after the providing step, the step of networking with a plurality of like computers to connect a plurality of players to play a single game.

In another aspect, the wagering step includes wagering, raising, and calling within a range of pre-established limits.

In a still further aspect, a fixed rake is retained from every round of wagering.

In yet another aspect, the combined wager pot is awarded to the player determined to have the highest ranking hand.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 2. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
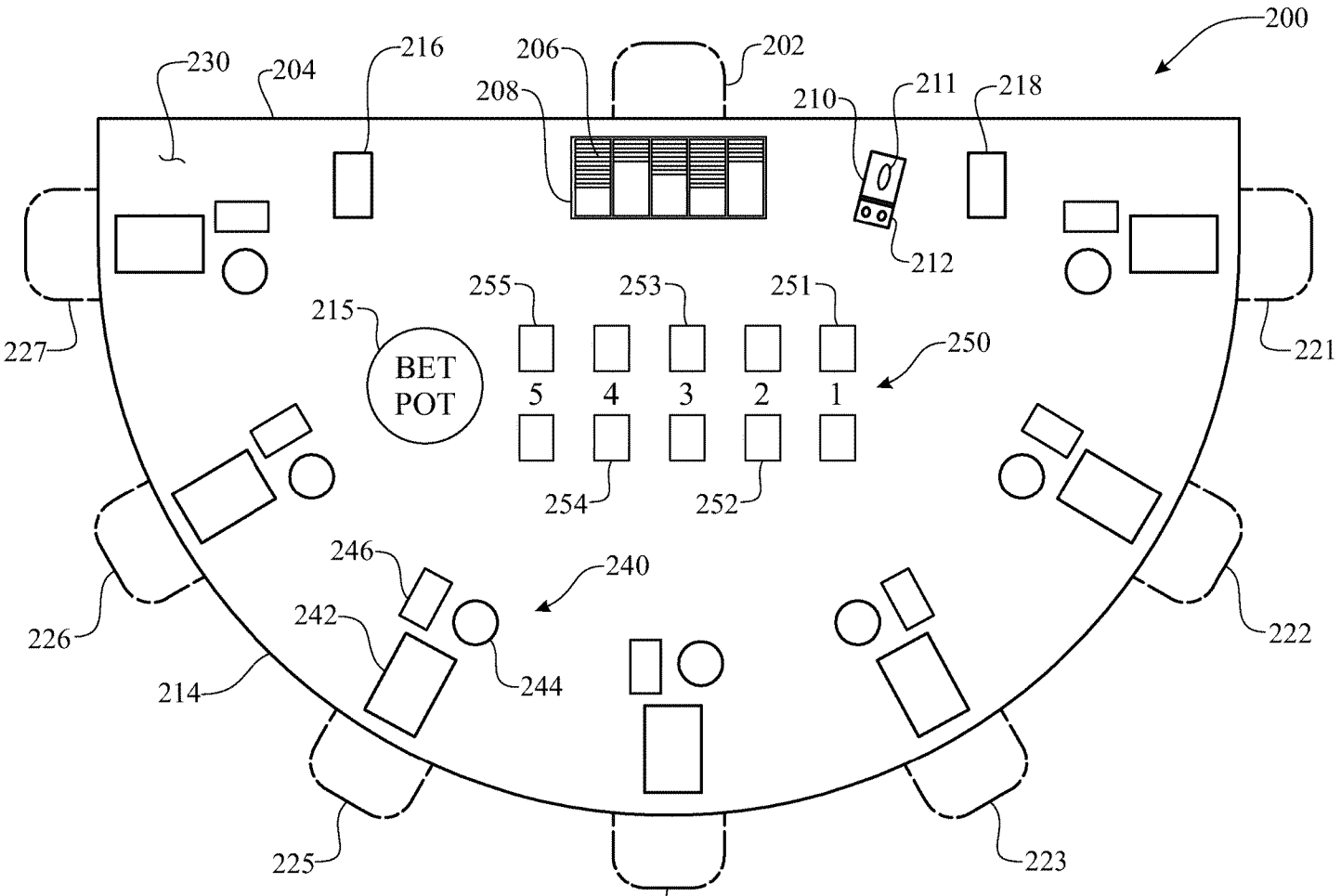
FIG. 2 presents a top plan view of a gaming table for a casino card game embodying the present invention, wherein the casino card game embodies five cards dealt to each player and five pairs of community cards.

In one exemplary implementation of the invention, the playing of a five-card Poker game utilizing a plurality of pairs of community cards is facilitated on a specialized layout gaming table 200 and is exemplified in FIG. 2. The gaming table 200 includes a playing surface 230 for playing the casino card game which is one of the preferred embodiments of the present invention and illustrates its various components. Playing surface 230 is typically made from a colored felt or other material that inhibits undesired sliding of playing cards on the surface 230 and includes a plurality of legend sets 240 printed thereon. The gaming table 200 can have a generally semi-circular shape, which is typical for a gaming table used at casinos and similar facilities. Those practiced in the art will recognize that other geometric configurations of a table may be used without deviating from the inventive concepts herein. A dealer stands at the center or dealer's station 202 of a straight side 204 of the gaming table 200. The dealer (also known as the banker and usually an employee of the casino hosting the game) is responsible for the chips 206 used for wagering by the players participating in the game. The chips 206 are organized and stored in a dealer's rack 208 for easy access by the dealer. This collection of chips 206 can also be referred to as "the Bank" at the gaming table 200 and is used to receive forfeited wagers and to payout winnings to the various players of the card game.

Figure 1:
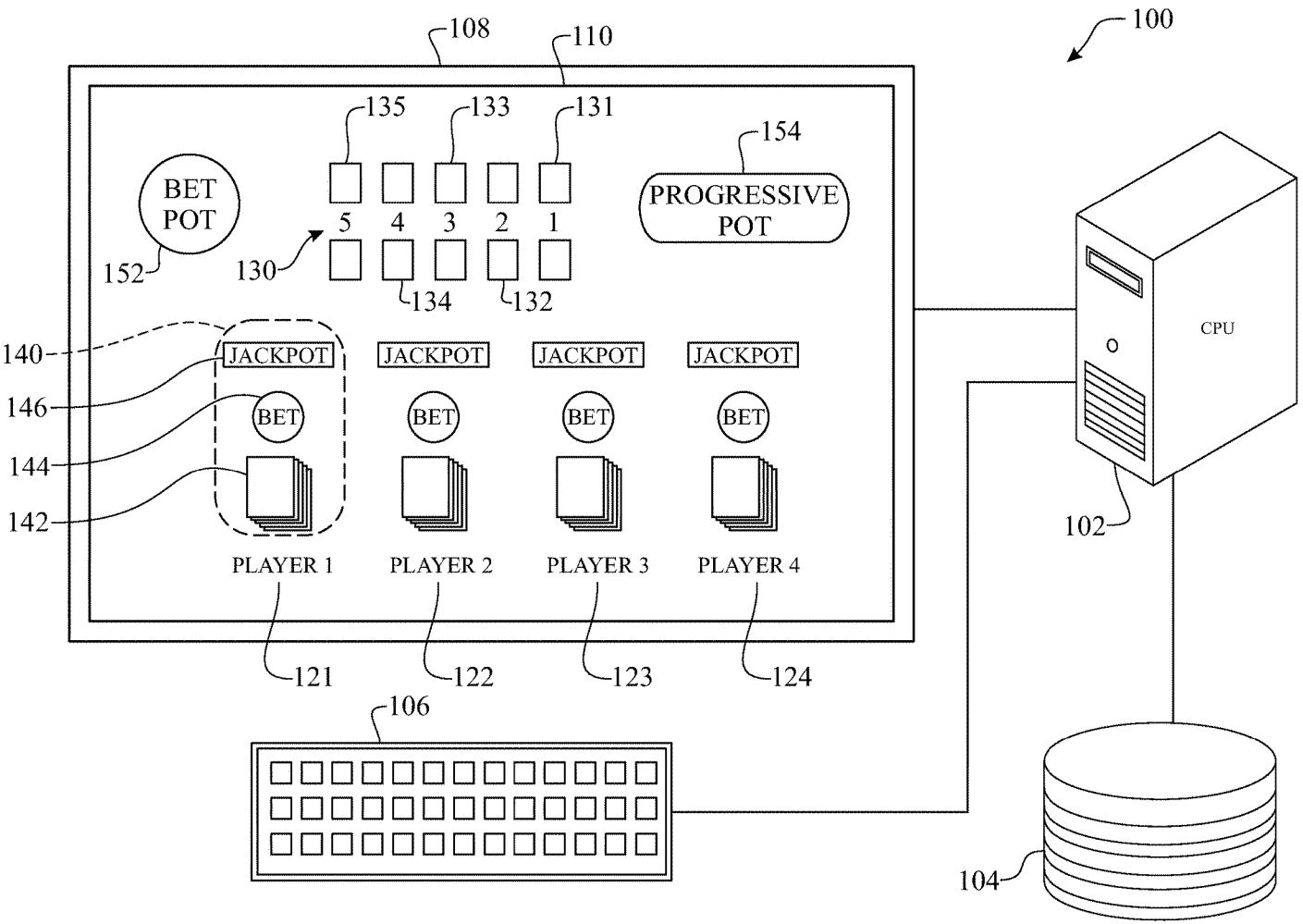
FIG. 1 presents a micro-processor based apparatus for implementing an embodiment of a casino card game, wherein the casino card game is based on five cards dealt to each player and a plurality of pairs of community cards.

A plurality of playing stations 221-227 are arranged around the dealer's station 202 in a semi-circular pattern along the semi-circular side 214 of the gaming table 200. While FIG. 1 illustrates the gaming table 200 as having seven playing stations 221-227, those practiced in the art will recognize that there can be alternate numbers of playing stations depending on the size of the gaming table 200 and the desires of the establishment hosting the game. Each playing station 221-227 has associated therewith a legend set 240 printed on playing surface 230 at the playing station. The legend set 240, as illustrated, includes a card placement legend 242 on which the player's cards are positioned during play of the game. A wagering legend 244 is utilized for placement of the player's ante and wagers during play, and a jackpot legend (or progressive jackpot chip slot) 246 is utilized to receive an optional progressive jackpot wager. A community card area 250 is centrally located on table surface 230 between the dealer's station 202 and the playing stations 221-227. The community card area 250 is divided to receive five community card pairs 251-255. A pot legend 215 receives the players' wagers after each round of betting. A jackpot legend 216 receives optional cumulative jackpot wagers placed by the players. A shuffling machine 210 is set to shuffle cards 212 and to deliver the cards 212 for distribution to the players 221-227 and to the community card area 250. The shuffle machine 210 can also include a random number generator which is activated by a button 211.

Figure 3:
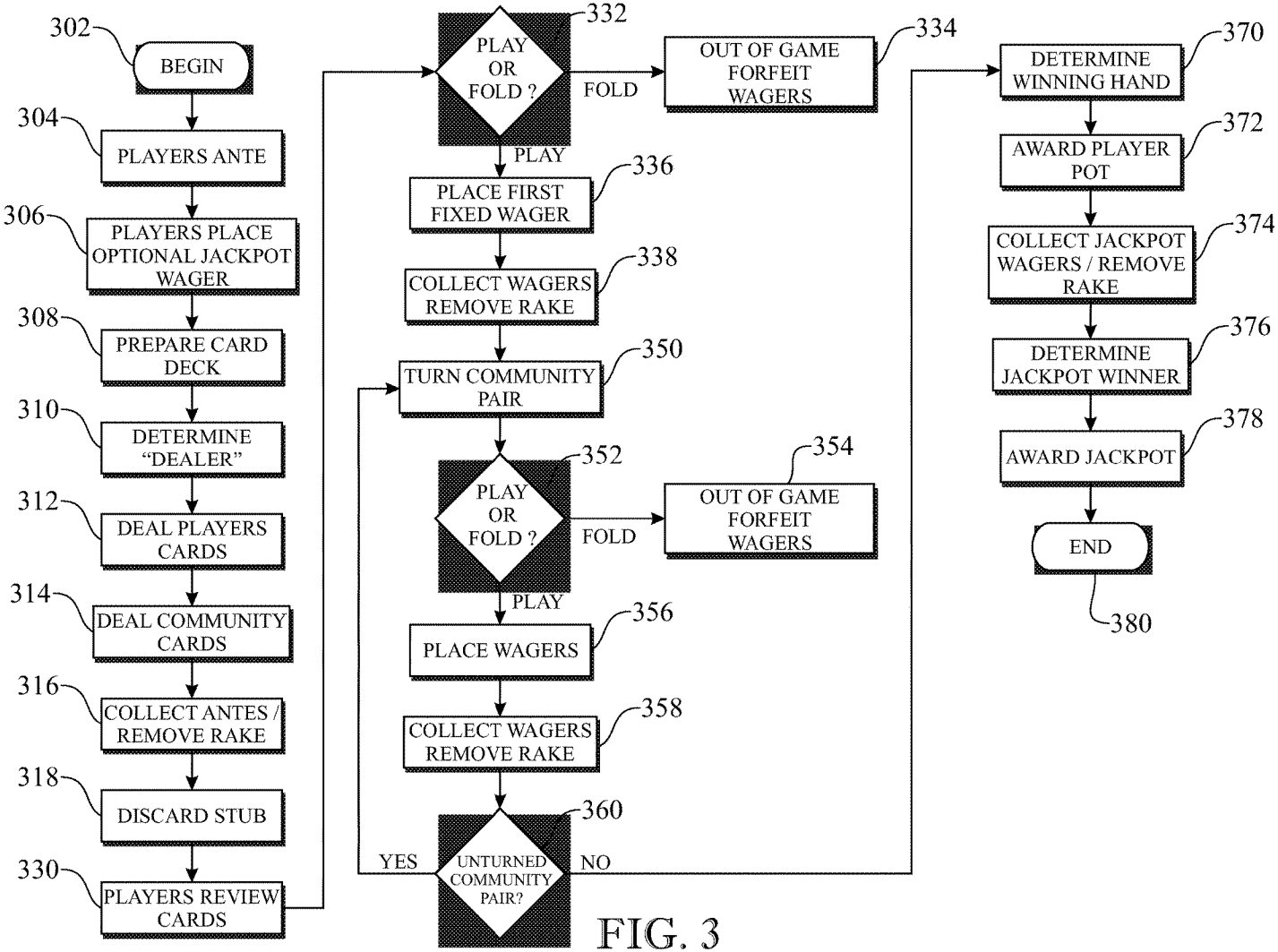
FIG. 3 presents a flow chart of an exemplary method of playing the casino card game.

One embodiment of a process for playing a round of a casino card game 300 according to the present invention is exemplified in FIG. 3. The card game 300 begins at block 302 and in block 304 the players located at one or more of the playing stations 221-227 place a fixed ante on their respective wagering legend 244 in order to receive cards. At this time, players can also, in block 306, place an optional progressive jackpot wager on their respective jackpot legend (or progressive chip receiving slot) 246 if the player wishes to be eligible for a progressive jackpot.

In block 308 the dealer prepares at least one deck of cards 212 for playing the casino card game. In typical casino play, a supervisor will obtain and open two different colored decks of cards. The supervisor will inspect each deck to ensure that the deck is a standard deck of fifty-two cards; there are no major flaws in the cards; the casino logo is present on the back of each card; and the two decks are of contrasting colors. The floor supervisor will give the decks of cards 212 to the house dealer 202 for inspection. The house dealer 202 will place one pre-inspected deck face up in the discard rack. The house dealer 202 will then begin to inspect the other deck. The house dealer 202 will inspect the cards 212 one deck at a time by spreading the cards 212 face-up on the table surface 230, exposing half of each card. The house dealer 202 will then use the same procedure to inspect the backs of the cards 212 (facedown). The house dealer 202 then inspects the cards twice from the back, turning them 180 degrees spreading them each time to make sure a full inspection of the backs of the cards 212 has been accomplished. The house dealer 202 inspects all cards for flaws, scratches, nicks, cribs, discoloration, or marks of any kind, and will notify the supervisor of any imperfections that are found during inspection.

After inspection of the first deck of cards 212 is complete, the house dealer 202 riffles the cards 212 one time and proceeds with washing the inspected deck within the working area of the house dealer 202. The house dealer 202 will use both hands, ensuring a thorough mix of the cards. Then, the house dealer 202 will riffle the cards one more time before he puts the card in the automatic shuffler 210. The house dealer 202 will repeat this process with the second deck of cards 212. If, on the other hand, used card decks are being utilized, the house dealer 202 will riffle one deck of cards 212 one time only and place the deck in the automatic shuffler 210. When the shuffle procedure is finished, the house dealer 202 will riffle the second deck of cards 212 one time only in place the deck in the shuffle machine 210.

As in a standard game of Poker, responsibilities of the dealer rotate among the various players so that the order of card distribution to the individual players is not identical from hand to hand. Consequently, although the house dealer 202 is the individual responsible for dealing cards 212 during every game, a "start hand" is established among the players 221-227 to rotate the order of card dealing among the players 221-227. The start hand is determined in block 310 by pressing the button 211 on the automatic shuffler 210 thereby activating a random number generator to determine the start hand. Alternatively, the start hand can commence at the first player position 221 and progress sequentially among the players 221-227 for subsequent games. Also, a button may be utilized to designate a start hand as in other Poker style games that make use of a community card "board" for the players. The house dealer 202 extracts five cards 212 from the automatic shuffler 210 and distributes the cards 212 face down to each player 221-227 beginning with the designated start hand. The house dealer 202 delivers each hand of five cards by fanning the cards directly behind each player's wagering legend 244.

Once the desired quantity of cards 212, and preferably five cards, have been distributed face down to each player 221-227, the house dealer 202 in block 314 deals the ten cards 212 to the community card area 250, thereby establishing the five community card pairs 251-255. The house dealer 202 delivers and spreads five cards to the top row of the community card area 250 and then delivers and spreads five cards to the bottom row of the community card area 250. After the cards have been distributed to players 221-227 and to the community card area 250 the house dealer 202 in block 316 collects the antes placed on the wagering legends 244 by the players 221-227. The house dealer 202 removes a fixed rake from the collected antes and places the remainder on the pot legend 215. The dealer then discards the stub in block 318 to a discard rack in a manner known in the industry.

Playing of the dealt hand begins in block 330 where the players 221-227 reviewed their respective hands. In block 332, each player decides after review of his dealt hand whether to play or fold. The eventual winning hand is based upon standard Poker card rankings, and in order from highest to lowest ranking the possible ranked hands are royal flush, straight flush, four-of-a-kind, full house, flush, straight, three of a kind, two pair, one pair and high card. If the player decides to fold, he is then eliminated from the present game, forfeits all wagers as indicated in block 334 and must wait until a new game commences. If, however, the players 221-227 decide in block 332 to play, the process advances to block 336 where each participating player places a first fixed wager on their respective wagering legend 244. All wagers are placed prior to the house dealer 202 announcing "no more bets." No bets may be increased or withdrawn by the player after the house dealer 202 has announced "no more bets." In block 338 the house dealer 202 collects the wagers, and after removing a fixed rake, places the collected wagers on the Bet Pot legend 215.

In block 350 the house dealer 202 turns the first community pair 251. In block 352 each of the remaining players 221-227 decide whether to play or fold based upon the highest poker hand makeable using the combination of their five dealt hole cards 212 on card legend 242 and the first turned community pair 251. If a player decides to fold, his play progresses to block 354 where he is removed from the game and forfeits all wagers previously made (including his ante wager). If, in block 352 a player 221-227 decides to play, the remaining players 221-227 in sequential manner, in block 356, place wagers, calls, and raises until all wagers have been called. Alternatively, the wagering by each of the players 221-227 can be restricted to placing a fixed predetermined wager on wagering legends 244. The house dealer 202 then, in block 358, collects the placed wagers from wagering legends 244, and after removing a fixed rake, places the collected wagers on the Bet Pot legend 215. In block 360 a determination is made whether there are any community pairs 251-255 remaining to be turned. If there are unturned community pairs 251-255, the process returns to block 352 turn the next in sequence community pair 251-255 for another round of wagering until all community pairs 251-255 have been turned.

If there are no further unturned community pairs 251-255 (all community cards have been exposed) the game progresses to block 370 where a winning hand of the remaining players 221-227 is determined. The remaining players 221-227 must place their cards face down in their assigned area and the players 221-227 cannot touch the cards after this procedure. The house dealer 202 exposes the first five-card hand starting to the right of the house dealer 202 by fanning the hand enough to read it and announce the value of the hand. The house dealer 202 shall announce and point to the community pair 251-255 being used for each players hand for verification of hand rank. The players 221-227 cannot use more than one pair to form a hand. The players have the option of not using any of the community pairs 251-255 to compete in the game or the Jackpot.

The house dealer 202 will then expose the next player's hand in a counter clockwise direction and compare the two hands. Once the house dealer 202 has determined the high hand, the house dealer 202 will then lock up the lesser value hand leaving the higher value hand exposed to be compared with the next hand proceeding in a counter clockwise direction. This procedure continues until all hands have been exposed and compared. All hand values use standard Poker ranking and the cards speak for themselves. The collective wagers on pot legend 215 are then awarded to the player 221-227 having the winning hand.

In block 374, the house dealer 202 collects the jackpot wagers from the players' jackpot legends 246, and after removing a fixed rake, places the jackpot wagers in a locked area of the dealer's rack 208. The house dealer 202 then determines in block 376 whether any of the players 221-227 that placed a jackpot wager have a hand qualified to win the progressive jackpot in jackpot legend 216. If one of the players 221-227 has a qualifying hand to win the jackpot, the jackpot is awarded to that player in block 378. However, if no player has a qualifying hand, the cumulative jackpot on jackpot legend 216 remains for the following game in a progressive manner. The game ends at block 380.

Referencing FIG. 1 and as an alternate to playing the casino card game on the gaming table 200, the method of playing the casino card game can be played utilizing a computer 100. Computer 100 includes a central processor 102 and a memory 104 on which is resident an instruction set embodying the casino card game and executable by the central processor 102. A user input device 106 such as a keyboard, keypad, or a unique set of user accessible buttons is communicative with central processor 102 for enabling user inputs, and a display 108 having a viewable screen 110 is also communicative with central processor 102. Alternatively, viewable screen 110 can be a touch screen that is responsive to being touched by the player and thus can also function as the user input device 106.

In use, execution of the instruction set resident on memory 104 is initialized and a card game display 120 is projected on screen 110. The card game display 120 can include a bet pot legend 152 and a progressive pot legend 154 on which are displayed the value amounts with respect to each pot. As illustrated, the game can be played by networking a plurality of players, such as four players 121-124, with their respective computers 100 to play a single game. Each player 121-124 is dealt a playing hand 142 represented by icons of five cards oriented in a face down manner. Each player position 121-124 also includes a wagering or bet legend 144 on which is illustrated a player's current wager and a jackpot legend 146 on which is illustrated a player's optional jackpot wager. One of the player icons 121-124 can represent the player at the viewing screen 110 and the remaining player icons can be players networked from other like viewing screens 110 or alternatively the remaining player icons can represent computer generated players to simulate competitive play. A community card area 130 includes up to five pairs 131-135 of community cards for use in progressive rounds of wagering. Play is initiated and proceeds according to the process as described above for the playing of a round of the game.

Alternatively, the card game display 120 includes a single player station 121. Execution of the instruction set resident on memory 104 varies slightly from the method of play 200. The player 121 utilizes the input device 106 to place an initial wager. A five-card representation is displayed on the card placement legend 142 for the player's hand and a plurality of community card pairs 131-135 are displayed in the community card area 130. The player 121 then decides whether to play or fold based on the five-card hand. If the player elects to continue play, the player places a fixed wager utilizing the input device 106. A community card pair 131 is exposed at which time the player 121 decides whether to play or fold. If the player 121 elects to continue play, a wager is entered utilizing the input device 106. The wager is collected and added to the wager pot 152. This procedure is repeated until all community pairs 131-135 are exposed and the player 121 has completed wagering. The highest ranking combination of the player's hand with one of the exposed community pairs 131-135 is then determined. Since the player 121 had no other players to compete against, the player is awarded a payoff based upon the odds of acquiring the determined highest ranking combination. The payoff can be less than or greater than the total accumulated wager placed by the player 121. As an option, the player 121 can place a wager on progressive pot 154. The progressive pot 154 is awarded when the combination of the player's hand with one of the exposed community pairs 131-135 ranks within a defined top category of hand rankings. For example, the progressive pot 154 can be awarded when the player's hand is either a royal flush or a straight flush. The progressive pot 154, if not awarded, carries over to subsequent rounds of play and subsequent players and continues to build until a player 121 acquires one of the defined top categories of hand rankings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents. For example, it will be apparent that although the preferred implementation of the game incorporates hand rankings based upon conventional High poker hands (i.e., High Card through Royal Flush), it is contemplated that the game may be implemented incorporating hand rankings based upon conventional Low poker hands (i.e., where the conventional lowest ranking poker hand is, for the purposes of the game, deemed the highest possible ranking hand). In that regard, the lowest hand may be Ace-2-3-4-5 (also referred to as the "Wheel"), or where the Wheel may not be considered as a qualifying "low" hand, the lowest hand may be Ace-2-3-4-6.

What is claimed is:

1. A computer-implemented method of playing a casino card game amongst a plurality of participating wagering players over a computer network, comprising steps of:

providing a central computer system having a central processing unit, a memory, a central computer system display having a viewable display screen, and a user input device;

storing an executable instruction set upon said central system computer memory, said executable instruction set pertaining to said casino card game and executable by said central processing unit;

establishing access over said computer network to said central computer system from at least one remote computer device, thereby providing to at least one remote player, of said plurality of participating wagering players, bi-directional communication between said at least one remote computer device and said central computer system;

displaying a digital image representation of a card game playing layout upon said central computer system viewable display screen, said card game playing layout concurrently displayed upon a corresponding viewable display screen of said at least one remote computer device, the digital image representation enabling interactive participation in said computer-implemented casino card game by each respective one of said plurality of participating wagering players of said casino card game, the card game playing layout displayed upon each said viewable display screen including a wagering pot icon, a community card area icon for displaying thereon digital images of a plurality of pairs of community cards, a progressive jackpot icon, and a plurality of player card playing and wagering station icons, each card playing and wagering station icon including a player card placement area for receiving a card playing hand dealt to each respective one of said plurality of participating wagering players, and a wagering icon for receiving a wager by each respective one of said plurality of participating wagering players;

applying a random number generator software algorithm to a digital deck of playing cards to randomize said playing cards from an initial order to a shuffled order, said random number generator software algorithm stored upon one of said central processing unit and said memory;

effecting the electronic dealing of a plurality of five-card playing hands, from said shuffled order of playing cards, to said plurality of participating wagering players, and displaying corresponding five-card digital image representations of each one of said five-card playing hands upon each respective player's card placement area, such that each participating wagering player's five-card playing hand is viewable only to that respective participating wagering player;

effecting, based upon said executable instruction set, the electronic dealing of a plurality of pairs of community cards, from said shuffled order of playing cards, and displaying a digital representation of each of said plurality of pairs of community cards in an unexposed face-down orientation upon the community card area displayed upon each participating player's respective viewable display screen;

establishing an initial wager and subsequently displaying a digital representation of said initial wager upon the respective player wagering icon of each of said plurality of participating wagering players;

exposing a digital representation of one of said plurality of pairs of community cards in a face up orientation viewable by each of said plurality of participating wagering players upon each player's respective viewable display screen, said exposed pair of community cards readily available for use by each of said participating wagering players, in addition to each player's previously-dealt five-card playing hand, to determine, for each participating wagering player, a highest 5-card poker ranking hand;

determining a course of action, by each respective one of said plurality of participating wagering players, each player's course of action selected from the group consisting of folding and playing;

wagering, by each of said plurality of participating wagering players whom has elected playing as a course of action, based upon the respective player's highest 5-card poker ranking hand using a combination of each player's respective previously-dealt five-card hand and one exposed pair of said community card pairs;

collecting each of said wagers for placement in the wagering pot, a digital representation of said collected wager amount displayed upon each respective player's wagering pot icon;

repeating said exposing step, said action determining step, said wagering step, and said collecting step until at least one of: all community card pairs are exposed, and only one of said plurality of participating wagering players remains as an active player in the current game;

determining, by said executable instruction set, a final highest 5-card poker ranking hand for each of said plurality of participating players that have not elected folding as a course of action, using a combination of the player's previously-dealt five-card playing hand and one of the exposed community card pairs; and awarding said collected wagers to an individual one of said plurality of participating wagering-players determined to have the highest 5-card poker ranking hand, amongst a subset of said plurality of participating wagering players that have not elected folding as a course of action.

2. A computer-implemented method of playing a casino card game as recited in claim 1, further comprising, prior to the step of effecting the electronic dealing of a plurality of five-card playing hands, steps of:

collecting a pre-wagering ante from each participating wagering player;

collecting a casino house rake from said pre-wagering antes, based upon said executable instruction set; and transmitting said pre-wagered antes, after deducting said collected casino house rake, into said wagering pot, a digital representation of said collected ante amount minus said casino house rake displayed upon each respective player's wagering pot icon.

3. A computer-implemented method of playing a casino card game as recited in claim 1 wherein said wagering step further comprises as least one of:

establishing a wager, based upon a wager input by one of said plurality of participating wagering players via that respective player's user input device, based upon the respective player's five-card hand; and establishing a fixed wager defined by the executable instruction set stored upon said central system computer memory, wherein a digital representation of said wager is displayed upon the respective player wagering icon of each respective player's viewable display screen.

4. A computer-implemented method of playing a casino card game claim 1, further comprising, prior to the step of effecting the electronic dealing of a plurality of five-card playing hands, a step of randomly determining via said executable instruction set, an initial starting dealer hand position from said plurality of participating wagering players, and sequentially rotating subsequent dealer hand positions following the playing of each game.

5. A computer-implemented method of playing a casino card game as recited in claim 1, further comprising, prior to the step of effecting the electronic dealing of a plurality of five-card playing hands, a step of receiving a progressive jackpot wager from at least one of said plurality of participating wagering players via the at least one participating wagering player's input device, said received progressive jackpot wager displayed upon the respective player progressive jackpot wagering icon and subsequently transmitted for addition to a progressive pot, a cash value of the progressive pot displayed upon each of the corresponding participating wagering player progressive pot icons, wherein the executable instruction set includes an implementation of a progressive jackpot carried forward from sequential previous player progressive jackpot wagers, said progressive pot awarded to a participating wagering player having a progressive pot qualifying high Poker hand defined by at least one qualifying progressive jackpot qualifying Poker hand as determined by said executable instruction set.

6. A method of playing a casino card game as recited in claim 1, wherein after the step of determining a course of action by each respective one of said plurality of participating wagering players, said executable instruction set effects the elimination of any of said participating wagering players electing to fold from participating in any further action pertaining to an ongoing game, any said eliminated players excluded from contention to win any of said wagering pot and said progressive pot until said ongoing game is completed.

7. A method of playing a casino card game as recited in claim 1, wherein the step of determining a course of action by each respective one of said plurality of participating wagering players further comprises selecting a course of action from the group consisting of folding, making an initial wager, calling a prior wager, and raising a prior wager.

* * * * *